US005104011A

United States Patent [19]

Clarke-Pounder et al.

[11] Patent Number: 5,104,011

[45] Date of Patent: Apr. 14, 1992

[54] SELF-CLEANING FEED APPARATUS

[75] Inventors: Ian J. H. Clarke-Pounder; Edward L. Farrar, both of Nashua, N.H.

[73] Assignee: Ingersoll-Rand Company, Woodcliff Lake, N.J.

[21] Appl. No.: 562,888

[22] Filed: Aug. 3, 1990

[51] Int. Cl.[5] ..... B67D 5/00

[52] U.S. Cl. ..... 222/504; 222/544; 251/208

[58] Field of Search ..... 222/310, 311, 367, 368, 222/414, 504, 544; 137/876, 861; 251/208

[56] References Cited

U.S. PATENT DOCUMENTS

| | | | |
|---|---|---|---|
| 192,622 | 7/1877 | Guild et al. | 251/304 |
| 2,613,906 | 10/1952 | Weimar | 251/208 |
| 3,633,489 | 1/1972 | Spoelhof et al. | 222/485 X |
| 4,053,088 | 10/1977 | Grataloup | 222/312 |
| 4,173,328 | 11/1979 | Karbo | 251/288 X |
| 4,373,560 | 2/1983 | Elsworth | 222/484 X |
| 4,509,556 | 4/1985 | Scanlon | 137/884 |
| 4,940,172 | 7/1990 | Möller et al. | 222/504 X |

FOREIGN PATENT DOCUMENTS

| | | | |
|---|---|---|---|
| 2805038 | 8/1979 | Fed. Rep. of Germany | 251/208 |
| 53-6221 | 2/1978 | Japan | 222/312 |

*Primary Examiner*—Michael S. Huppert
*Assistant Examiner*—Anthoula Pomrening
*Attorney, Agent, or Firm*—Walter C. Vliet

[57] ABSTRACT

A variable throttling feed apparatus, commonly known as a slice for breaking down clumps of fiber in various fiber processes, comprises a rotatable half round feed aperture bar which cooperates with the side of a cross flow feed chamber to form both a portion of the wall of that chamber when rotated in one direction to facilitate cleaning and a variable slice when rotated to partially open positions which permit the fiber to flow from the cross flow channel along its length.

8 Claims, 1 Drawing Sheet

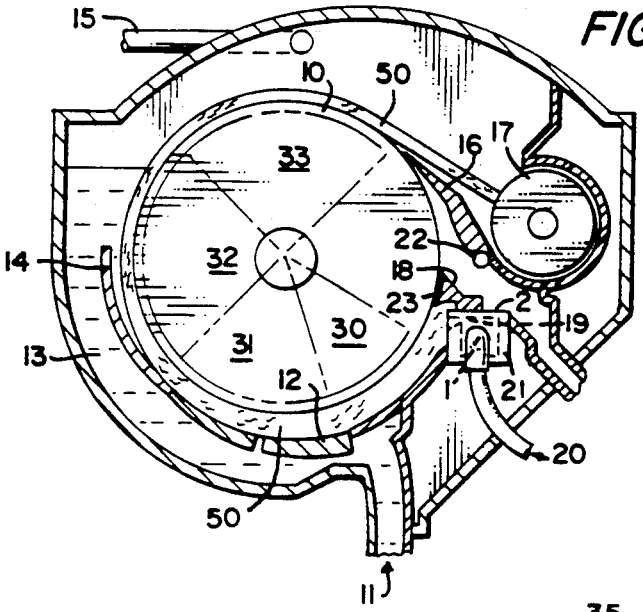
FIG. 1 (PRIOR ART)
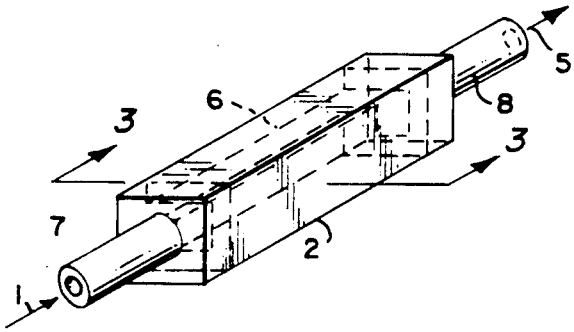
FIG. 2 (PRIOR ART)
FIG. 5
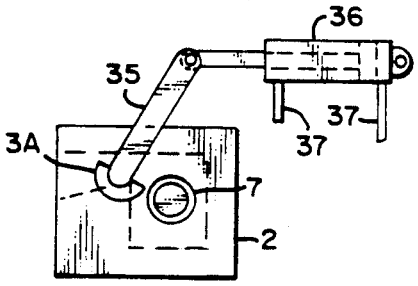
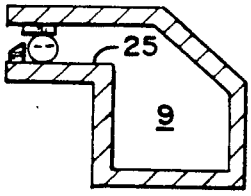
FIG. 3A (PRIOR ART)
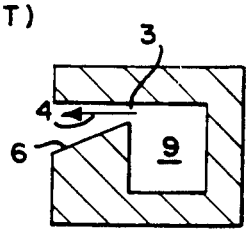
FIG. 3 (PRIOR ART)
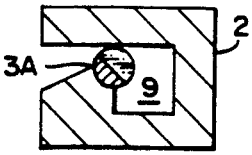
FIG. 4
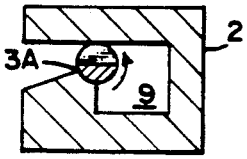
FIG. 4A
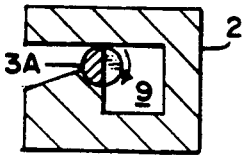
FIG. 4B

SELF-CLEANING FEED APPARATUS

BACKGROUND OF THE INVENTION

This invention relates generally to filters and more particularly to throttling feed apertures commonly known a slices.

In various devices such as filters of slurries, in particular slurries of fibrous materials such as papermaking pulp, throttling feed apertures are employed to break down clumps of fiber known commonly as "flocs". To accomplish this, throttling feed apertures provide a desired exit velocity and promote uniform distribution across the length of the device. A typical prior art feed manifold with fixed slice exit is shown in FIG. 1 and FIG. 2 of the attached drawings. Such manifolds are often fed with excess flow, such excess flow being recirculated to enhance uniformity and avoid stagnation which might occur in a dead headed chamber. Net flow through the slice is then the total flow entering the manifold minus the excess flow which is recirculated. Fixed slice openings, however, lack versatility in feed selection and are subject to plugging and cannot be unplugged during operation. FIG. 3 shows a typical prior art fixed slice. FIG. 3A shows a variable slice of a prior art type mounted in a side distribution channel 25.

Hithertofore variable slices have been purged of plugs by opening the slice exit to its wide open position to allow the plug material to be forced out. This is a significant drawback since the released plug material can only pass into the filter or like downstream apparatus which can cause significant damage to drum surfaces or product, etc. and/or reduce the performance of the filter to form a pulp mat when the plug material is too large to pass small narrow openings in the filter structure e.g., compacting baffle tip openings.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a self-cleaning feed apparatus comprising a generally elongate chamber having an exit along its length to provide a metered flow of fibrous feed substantially free of fiber clumps. Means are provided in the exit proximate the elongate chamber for controlling the flow of feed from a minimum to a maximum flow. The means for controlling the exit fluid flow forms a throat in a first position for producing a desired feed flow rate and shuts off the flow through the exit in a second position to promote longitudinal flow through said elongate chamber as a means of clearing said chamber.

BRIEF DESCRIPTION OF THE DRAWINGS

FIG. 1 is a pictorial cross section of a slurry filter commonly employed in the pulpmaking industry;

FIG. 2 is an isometric sketch of a throttling feed aperture slice according to the prior art;

FIG. 3 is a cross section of the prior art slice shown in FIG. 2 taken at Section 3—3;

FIG. 3A is a cross section of a variable slice according to the prior art located in a side distribution channel;

FIGS. 4, 4A, and 4B are cross sections illustrating an embodiment of the new adjustable throttling feed aperture of the present invention shown operationally open in FIG. 4, fully open in FIG. 4A to effect a gravity dump, and fully closed to bypass the slice in FIG. 4B; and FIG. 5 is an end view illustrating an embodiment of the present invention showing a hydraulic cylinder operator for adjusting the slice bar rotation.

DESCRIPTION OF THE PREFERRED EMBODIMENT

FIG. 1 shows a compaction baffle filter commonly used for removal of process liquor in the papermaking pulp industry. The compaction baffle filter is a pressurized drum filter which achieves high capacity by using high feed consistency and higher operating speed. This results in a compact machine requiring much less building space than a conventional vacuum or pressure filter. Pulp at, for example, 3 to 5 percent consistency, is pumped into the filter through stock inlet 20 and distributed by means of an inlet box 21. It is then discharged into the drum filter area through a slice 19, where it contacts and is moved along with rotating drum 10. The drum being porous receives the liquor from the pulp and a mat 50 is formed on the drum. This occurs in an area designated 30 generally referred to as the forming zone. The mat 50 is then further compressed by a compression baffle 12 which is a tapered clearance baffle. This further presses the liquor out of the mat 50, the liquor being collected in the drum interior, generally in the compaction zone 31. A wash liquor is introduced in the flooded zone 13 below the baffle through inlet 11 and is introduced to the surface of the mat 50, which is now formed and compacted on the drum, in the gap provided between the mat 50 and an excluder baffle 14. The wash liquor passing through the mat 50 and entering the collecting drum 10 removes more of the remainder of the process liquor by displacing it with the wash liquor. The formed and washed mat 50 still progressing around the filter drum 10 from the forming zone 30 to the compaction zone 31 to the washing zone 32 now progresses to the drying zone 33 where pressurized air entering the filter through inlet 15 passes through the mat further removing the washing liquor. After progressing through the drying zone 33 the mat is removed by means of a doctor 16 and disposed to subsequent processing by a breaker conveyor 17. The drum is cleaned by a shower 22 and remaining particles removed from the drum by deflector 18. Back flow on the filter drum from forming zone 30 is prevented by means of a face seal 23. The process is repeated as the drum again passes the face seal for continuous operation.

Similar slices are utilized for twin roll presses and other similar fiber process equipment.

FIG. 2 shows a slice commonly employed in the prior art having a stock inlet 7 which receives the process stock 1 containing the fibrous pulp and process liquor. The stock is introduced into the slice manifold 2 into an interior formed chamber 9 best seen on FIG. 3. The feed stock is under pressure and exits the interior formed chamber 9 through the slice 4 having a sharp edged throat 3 and an expanding nozzle portion 6 whereby the feed stock exiting the slice 4 is introduced at high velocity and agitation to the filter drum forming area generally designated as 30 best seen by way of example in FIG. 1. The combination of high velocity and turbulence prevents the formation of pulp flocs in the filter and promotes uniform distribution of the pulp on the surface of the drum. In order to promote uniform distribution along the manifold a portion of the feed stock is allowed to exit the interior formed chamber 9 through outlet 8. The exiting feed stock is recycled through a pump (not shown) to the inlet 7.

FIGS. 4, 4A, and 4B show a modified slice according to the present invention wherein a rotatable bar 3A is shown placed in the elongate generally rectangular cross section manifold of FIG. 2 to control the exiting feed stock rather than in a side distribution chamber as taught by the prior art (see FIG. 3A). The rotatable bar 3A is cut through approximately half its diameter to form a semi-circular segment which forms the throat of the slice as can be seen in FIGS. 4 through 4B. The bar 3A may be rotated from a partially open position (FIG. 4), to a fully open position (shown in FIG. 4A) or a fully closed plug dumping position (as shown in 4B). The advantage of the adjustable slice is that the exit velocity may be controlled as desired for optimum mat formation and prevention of floc formation and in addition in the event of a plug being formed in the slice aperture, the rotatable bar 3A may be rotated to a fully closed or plug flushing or dumping position which completely blocks off the slice as shown in 4B whereby the plug is flushed by feed stock through the manifold and may be returned to the pump where the plug may be broken up and returned to the manifold.

FIG. 5 shows an end view of the slice according to the present invention showing one means of rotating the bar 3A. In the FIG. 5 embodiment this is accomplished by a lever 35 operated by a hydraulic cylinder 36 activated by a controlled supply of hydraulic fluid (not shown) through hoses 37 and 37'.

Having described our invention in terms of a preferred embodiment, numerous modifications of the present invention will occur to one skilled in the art. We do not wish to be limited in the scope of our invention except as claimed.

What is claimed is:

1. A self-cleaning feed apparatus for slurries of fibrous material comprising:

a generally elongate chamber having an inlet at one end and an outlet at the opposite end and an exit slice along its length to provide a metered flow of slurries of fibrous feed substantially free of fiber clumps;

means provided at the entrance of said exit slice for controlling the flow of feed from a minimum to a maximum flow, said means for controlling the flow forms a throat in a first position for producing a desired feed flow rate and for shutting off the flow through and blocking the entrance to said exit slice in a second position to promote longitudinal flow through said elongate chamber from said inlet to said outlet as a means of clearing said chamber of fibrous clumps.

2. A self-cleaning feed apparatus according to claim 1 wherein said means provided in said exit slice for controlling the flow from a minimum to a maximum flow further comprises a rotary member.

3. A self-cleaning feed apparatus according to claim 2 wherein said rotary member further comprises a half-round bar disposed longitudinally along said exit slice wherein said half-round bar in a first position substantially allows unobstructed flow through said exit slice and said half-round bar in a second position substantially blocks said exit slice.

4. A self-cleaning feed apparatus according to claim 3 wherein said half-round bar cooperates with a generally elongate slot in the side of said chamber to form an exit slice which is adjustable.

5. A self-cleaning feed apparatus according to claim 4 wherein said half-round bar cooperates with an arcute seat formed in said generally elongate chamber to both seal and guide said half-round bar in rotation.

6. A self-cleaning feed apparatus according to claim 3 wherein means are provided for rotating said half-round bar from a minimum flow condition to a maximum flow condition.

7. A self-cleaning feed apparatus according to claim 6 wherein said means for rotating said half-round bar further comprises a hydraulic cylinder connected to said half-round bar by a lever means.

8. A self-cleaning feed apparatus according to claim 1 wherein said means for controlling the flow when in a minimum flow position allows longitudinal flushing of said generally elongate chamber.

* * * * *